US009458690B2

(12) United States Patent
Moellendick

(10) Patent No.: US 9,458,690 B2
(45) Date of Patent: Oct. 4, 2016

(54) ROTATING CASING HANGER

(75) Inventor: Timothy Eric Moellendick, Houston, TX (US)

(73) Assignee: TESCO CORPORATION, Houston, TX (US)

( * ) Notice: Subject to any disclaimer, the term of this patent is extended or adjusted under 35 U.S.C. 154(b) by 744 days.

(21) Appl. No.: 13/485,599

(22) Filed: May 31, 2012

(65) Prior Publication Data

US 2013/0319688 A1 Dec. 5, 2013

(51) Int. Cl.
*E21B 33/04* (2006.01)

(52) U.S. Cl.
CPC ..... *E21B 33/0415* (2013.01)

(58) Field of Classification Search
CPC ..... E21B 33/0415; E21B 7/20; E21B 33/04; E21B 43/10
USPC ..... 166/88.3, 382, 78.1, 84.3, 208
See application file for complete search history.

(56) References Cited

U.S. PATENT DOCUMENTS 2,599,039 A * 6/1952 Baker ..... E21B 33/0415 166/78.1
3,171,490 A * 3/1965 States ..... E21B 43/10 166/124
3,720,261 A * 3/1973 Heilhecker ..... E21B 33/0415 166/208
4,926,938 A * 5/1990 Lindsey, Jr. ..... E21B 43/10 166/117.7
5,732,777 A * 3/1998 Grimshaw et al. ..... 166/382
5,964,286 A * 10/1999 Cuppen ..... 166/78.1
6,026,898 A * 2/2000 Bland ..... E21B 33/0415 166/78.1
6,199,630 B1 * 3/2001 Blundell et al. ..... 166/78.1
6,640,892 B1 * 11/2003 Wright ..... 166/78.1
7,926,559 B2 * 4/2011 Salloum ..... E21B 33/085 166/78.1
8,272,434 B2 * 9/2012 Garcia ..... 166/78.1
8,528,650 B1 * 9/2013 Smith ..... E21B 19/06 166/208
2002/0121367 A1 * 9/2002 Meek et al. ..... 166/78.1
2004/0112603 A1 * 6/2004 Galloway ..... E21B 7/061 166/358
2005/0230099 A1 * 10/2005 Thomson et al. ..... 166/78.1
2010/0243261 A1 * 9/2010 Fern ..... E21B 33/0415 166/348
2010/0326664 A1 * 12/2010 Neto ..... E21B 33/04 166/336
2012/0305269 A1 * 12/2012 Bories ..... E21B 33/0415 166/382

* cited by examiner

*Primary Examiner* — Michael Wills, III
(74) *Attorney, Agent, or Firm* — Fletcher Yoder, P.C.

(57) ABSTRACT

The disclosed embodiments include a rotating casing hanger having a housing configured to abut a casing spool and a casing hanger body disposed within the housing, wherein the casing hanger body is configured to suspend a casing element within a wellbore, and the casing hanger body is configured to rotate within the housing.

18 Claims, 4 Drawing Sheets

ROTATING CASING HANGER

FIELD OF DISCLOSURE

The present disclosure relates generally to the field of well drilling operations. More specifically, embodiments of the present disclosure relate to rotating casing hangers for use with casing and cementing in a down-hole environment.

BACKGROUND

In conventional oil and gas operations, a well is typically drilled to a desired depth with a drill string, which includes drill pipe and a drilling bottom hole assembly (BHA). Once the desired depth is reached, the drill string is removed from the hole and casing is run into the vacant hole. In some conventional operations, the casing may be installed as part of the drilling process. A technique that involves running casing at the same time the well is being drilled may be referred to as "casing-while-drilling."

Casing may be defined as pipe or tubular that is placed in a well to prevent the well from caving in, to contain fluids, and to assist with efficient extraction of product. When the casing is properly positioned within a hole or well, the casing is typically cemented in place by pumping cement through the casing and into an annulus formed between the casing and the hole (e.g., a wellbore or parent casing). Once a casing string has been positioned and cemented in place or installed, the process may be repeated via the now installed casing string. For example, the well may be drilled further by passing a drilling BHA through the installed casing string and drilling. Further, additional casing strings may be subsequently passed through the installed casing string (during or after drilling) for installation. Indeed, numerous levels of casing may be employed in a well. For example, once a first string of casing is in place, the well may be drilled further and another string of casing (an inner string of casing) with an outside diameter that is accommodated by the inside diameter of the previously installed casing may be run through the existing casing. Additional strings of casing may be added in this manner such that numerous concentric strings of casing are positioned in the well, and such that each inner string of casing extends deeper than the previously installed casing or parent casing string.

BRIEF DESCRIPTION

In a first embodiment, a system includes a rotating casing hanger having a housing configured to abut a casing spool and a casing hanger body disposed within the housing, wherein the casing hanger body is configured to suspend a casing element within a wellbore, and the casing hanger body is configured to rotate within the housing.

In a second embodiment, a casing hanger includes a housing having a first housing portion, a second housing portion, and a seal at least partially captured by the first housing portion and the second housing portion, wherein the seal is configured to abut a casing spool when the casing hanger is disposed within the casing spool. The casing hanger also includes a casing hanger body disposed within the housing, wherein the casing hanger body is configured to couple to a casing element and rotate within the housing.

In a third embodiment, a method includes coupling a casing element to a casing hanger, landing the casing hanger in a casing spool and the casing element in a wellbore, and rotating the casing hanger within the casing spool and the casing within the wellbore while the casing hanger is landed in the casing spool and the casing element is landed in the wellbore.

DRAWINGS

These and other features, aspects, and advantages of the present invention will become better understood when the following detailed description is read with reference to the accompanying drawings in which like characters represent like parts throughout the drawings, wherein.

Figure 4:
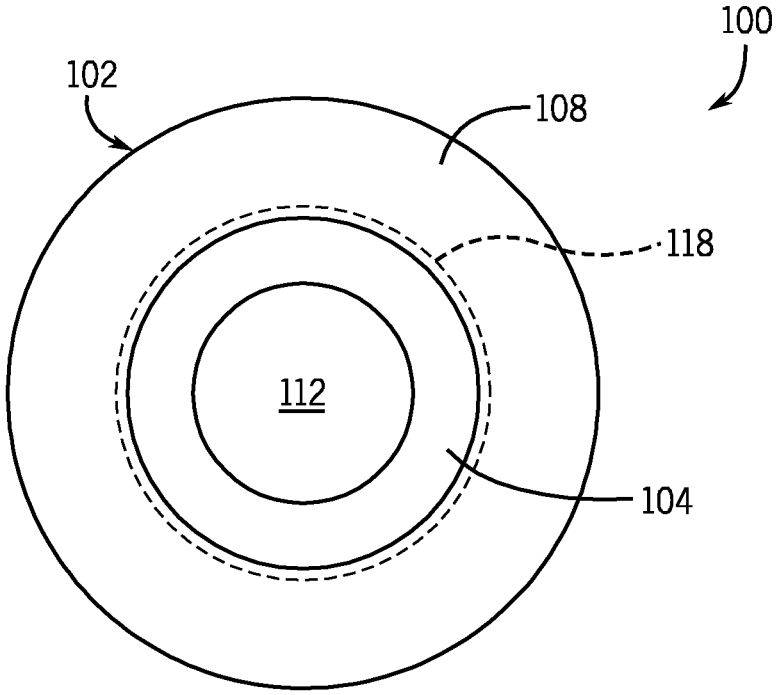
Figure 5:
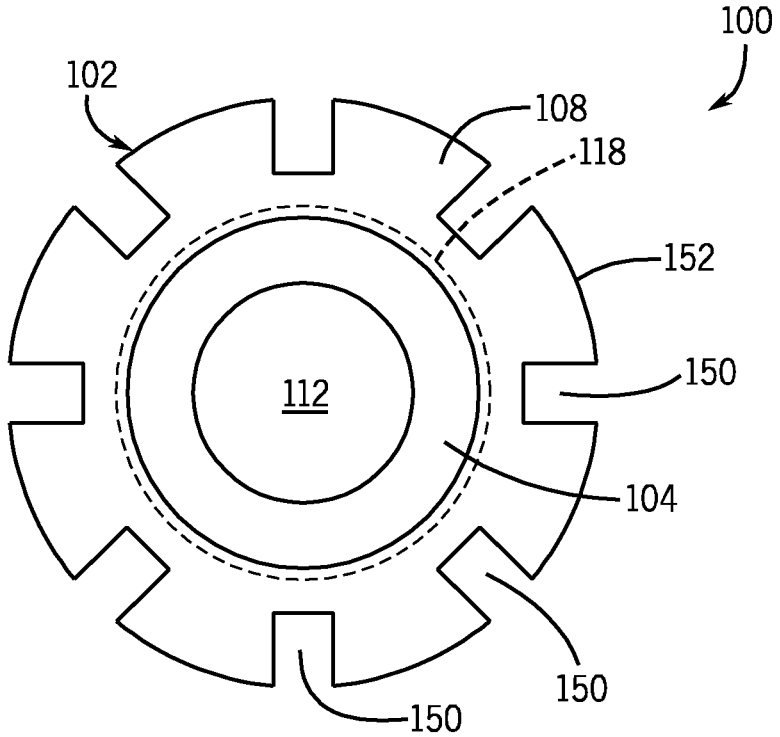
Figure 6:
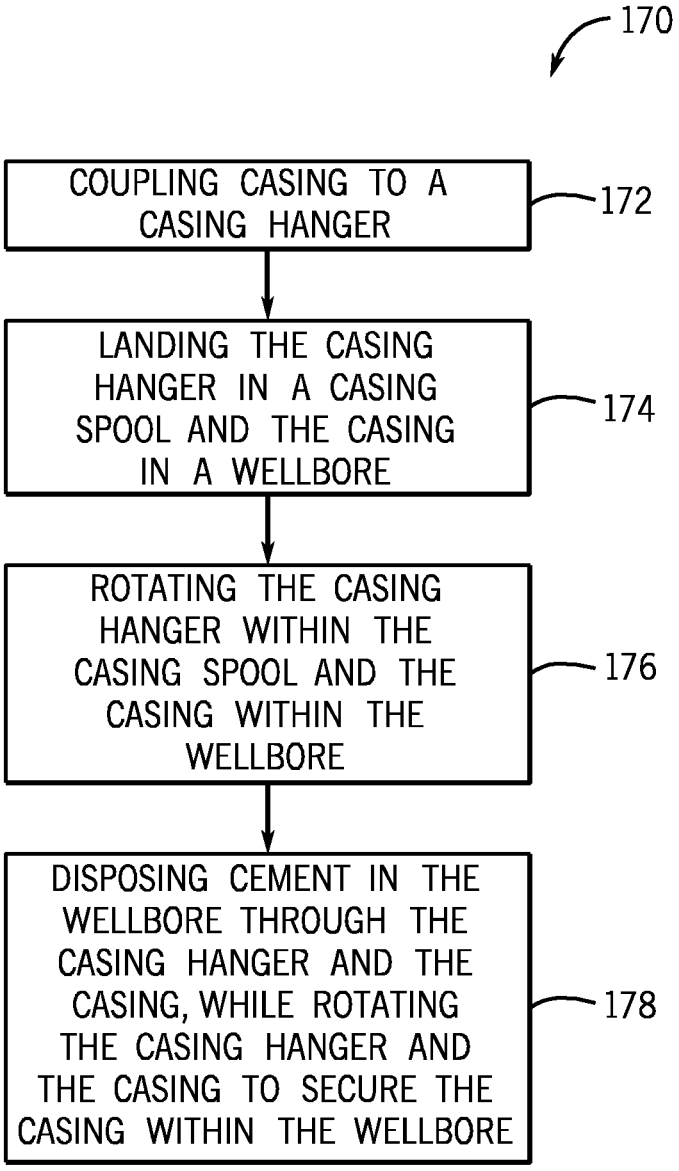

FIG. 4 is a schematic axial view of an embodiment of the rotating casing hanger, in accordance with aspects of the present disclosure; and FIG. 5 is a schematic axial view of an embodiment of the rotating casing hanger, in accordance with aspects of the present disclosure; and FIG. 6 is a flow chart of a method of using a rotating casing hanger, in accordance with aspects of the present disclosure.

DETAILED DESCRIPTION

The present disclosure relates generally to a rotating casing hanger, which may be used with down-hole equipment. For example, the rotating casing hanger may be used for rotating casing while drilling a well or while cementing the casing within a wellbore of the well. In accordance with the present disclosure, this may include rotating and cementing casing within previously installed casing. More specifically, in certain embodiments, a casing element (e.g., a casing string) supported by the rotating casing hanger may be landed before the annular space between the wellbore and the casing is filled with cement. In one embodiment, landing the rotating casing hanger includes abutting a fixed portion of the rotating casing hanger against a casing spool, which results in the landing of casing attached to the rotating casing hanger at a desired depth within the wellbore.

While the casing hanger is landed, cement may be pumped into the well, while the casing (e.g., a casing string) is rotated by the rotating casing hanger. In other words, the casing may be positioned within the well and supported by the rotating casing hanger, which itself is supported by a casing bowl or spool. Once the rotating casing hanger is supporting the casing (e.g., casing string), cement may be pumped through the casing to the bottom of the well, and the cement may fill the annulus between the wellbore and the casing. The cement will eventually set and thereby fix the casing in place within the well. It should be noted that a wellbore may include parent casing in accordance with the present disclosure. As the cement is pumped into the well, the rotating casing hanger may enable rotation of the casing within the well. In this manner, the cementing process may be improved. For example, rotating the casing while the casing is in the process of being cemented in place may improve efficiency of the cementing process and/or may improve the quality of the cementing process. Furthermore, embodiments of the rotating casing hanger disclosed below may be configured to maintain a seal between the rotating casing hanger and the casing bowl or spool while rotating the casing. Additionally, present embodiments may facilitate continuous abuttal between the rotating casing hanger and the casing bowl or spool during rotation of the casing coupled to the casing hanger.

Figure 1:
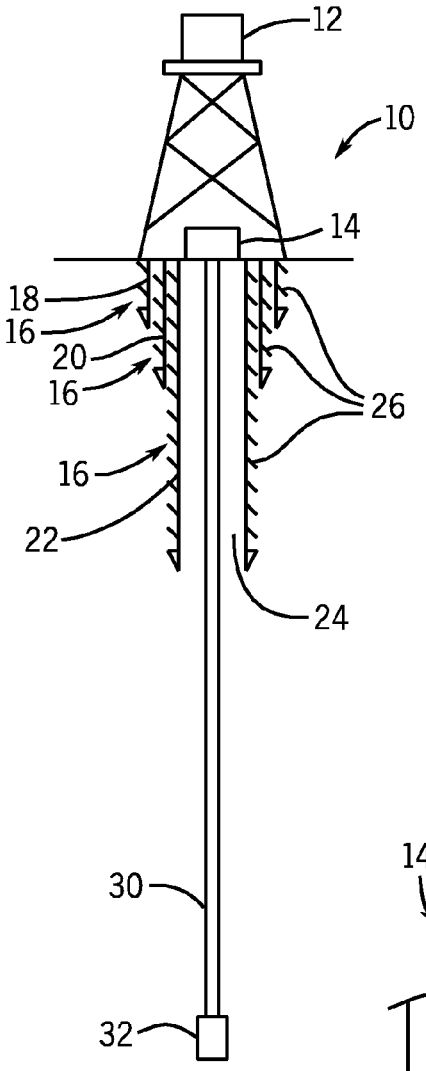
FIG. 1 is a schematic representation of a well being drilled, in accordance with aspects of the present disclosure.

Turning now to the drawings, FIG. 1 is a schematic representation of a well 10 that is being drilled using a rotating casing hanger. In the illustrated embodiment, the well 10 includes a derrick 12, wellhead equipment 14, and several levels of casing 16 (e.g., pipe). For example, the well 10 includes a conductor casing 18, a surface casing 20, and an intermediate casing 22. In certain embodiments, the casing 16 may include 42 foot segments of oilfield pipe having a suitable diameter (e.g., 13⅜ inches) that are joined as the casing 16 is lowered into a wellbore 24 of the well 10. As will be appreciated, in other embodiments, the length and/or diameter of segments of the casing 16 may be other lengths and/or diameters. The casing 16 is configured to isolate and/or protect the wellbore 24 from the surrounding subterranean environment. For example, the casing 16 may isolate the interior of the wellbore 24 from fresh water, salt water, or other minerals surrounding the wellbore 24.

The casing 16 may be lowered into the wellbore 24 with a running tool. As shown, once each level of casing 16 is lowered into the wellbore 24 of the well, the casing 16 is secured or cemented in place with cement 26. As described in detail below, the cement 26 may be pumped into the wellbore 24 after each level of casing 16 is landed in place within the wellbore 24. That is, each level of casing 16 may be individually lowered within the wellbore 24 and supported by a rotating casing hanger, which is described below. Thereafter, the cement 26 may be pumped through the casing 16 and into the wellbore 24, where the cement 26 may set and secure the casing 16 in place, as shown. Additionally, as the cement 26 is pumped into the wellbore 24 through the casing 16, the rotating casing hanger, which is generally represented as being included as a component of the wellhead equipment 14, may rotate the casing 16. In this manner, present embodiments facilitate flowing and setting of the cement 26 within the wellbore 24 more efficiently and effectively.

Figure 2:
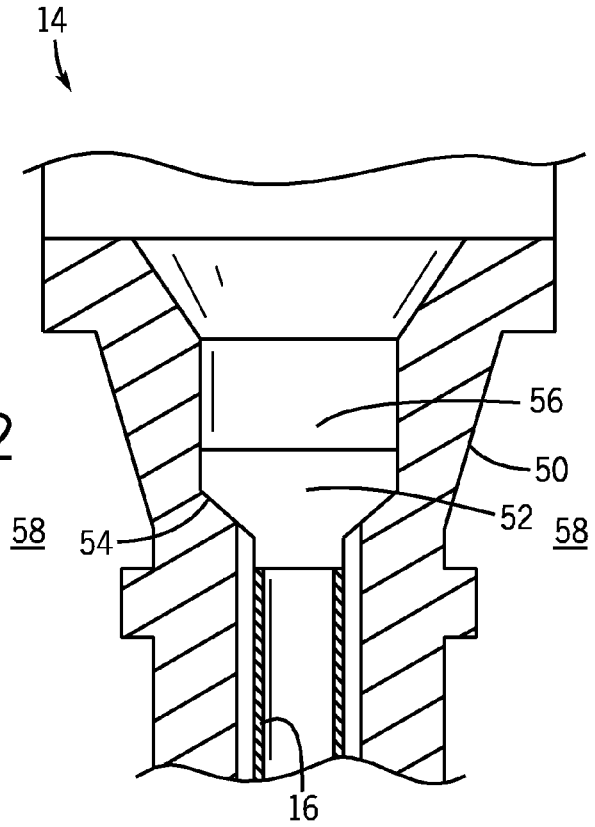
FIG. 2 is a schematic partial cross-sectional side view of an embodiment of wellhead equipment, including a casing spool supporting a casing hanger, in accordance with aspects of the present disclosure.

FIG. 2 is a partial cross-sectional schematic view of certain aspects of the wellhead equipment 14. In the illustrated embodiment, the wellhead equipment 14 includes a casing bowl or spool 50, which supports a casing hanger 52. As will be appreciated, the wellhead equipment 14 may also include a variety of other components configured to support other drilling and production equipment of the well 10. For example, the wellhead equipment 14 may include components configured to suspend casing 16 or tubing disposed within the wellbore 24, components configured to regulate and monitor flow of drilling fluid or production fluid, components configured to monitor pressure of drilling fluid or production fluid, and so forth.

In the illustrated embodiment, the casing spool 50 is configured to support the casing hanger 52, and the casing hanger 52 is configured to engage the casing spool 50. More specifically, the casing spool 50 includes a load shoulder 54 configured to engage with and support the casing hanger 52 within a bore 56 of the casing spool 50. As mentioned above, the casing hanger 52 is configured to support and suspend the casing 16 within the wellbore 24. Furthermore, the casing hanger 52 may have various different configurations. That is, the casing hanger 52 may couple to and hold the casing 16 in different manners. For example, the casing hanger 52 may be a slip type casing hanger, a self sealing casing hanger, or a mandrel type casing hanger. With the casing 16 suspended within the wellbore 24 by the casing hanger 52, cement 26 may be pumped into the wellbore 24 for eventually securing the casing 16 within the wellbore 24.

As discussed in detail below, the casing hanger 52 is configured to be a rotating casing hanger (e.g., rotating casing hanger 100 shown in FIG. 3 below). Specifically, the casing hanger 52 may be configured to facilitate landing the casing 16 within the wellbore 24 (i.e., the casing hanger 52 may be configured to support and suspend the casing 16 within the wellbore 24) and rotating the casing 16 within the wellbore 24 while landed. For example, the casing hanger 52 may be configured to enable rotation of the casing 16 while cement 26 is pumped into the wellbore 24 through the casing 16 and the casing hanger 52 is abutting the casing spool 50. Furthermore, the casing hanger 52 may be configured to maintain a seal or sealing interface between the casing spool 50 and the casing hanger 52. Consequently, cement 26, drilling fluid, production fluid, and/or other fluid flowing through the casing spool 50 and the casing 16 may be blocked from flowing from within the bore 56 of the casing spool 50 to the environment 58 surrounding the casing spool 50 and the wellhead equipment 14. Similarly, fluids and/or particles (e.g., fresh water or minerals) outside the casing spool 50 may be blocked from flowing from the environment surrounding the casing spool 50 and the wellhead equipment 14 (e.g., indicated by reference numeral 58) into the bore 56 of the casing spool 50, thereby blocking contamination of the cement 26, drilling fluid, production fluid, or other fluid passing through the casing spool 50 and the casing 16.

Figure 3:
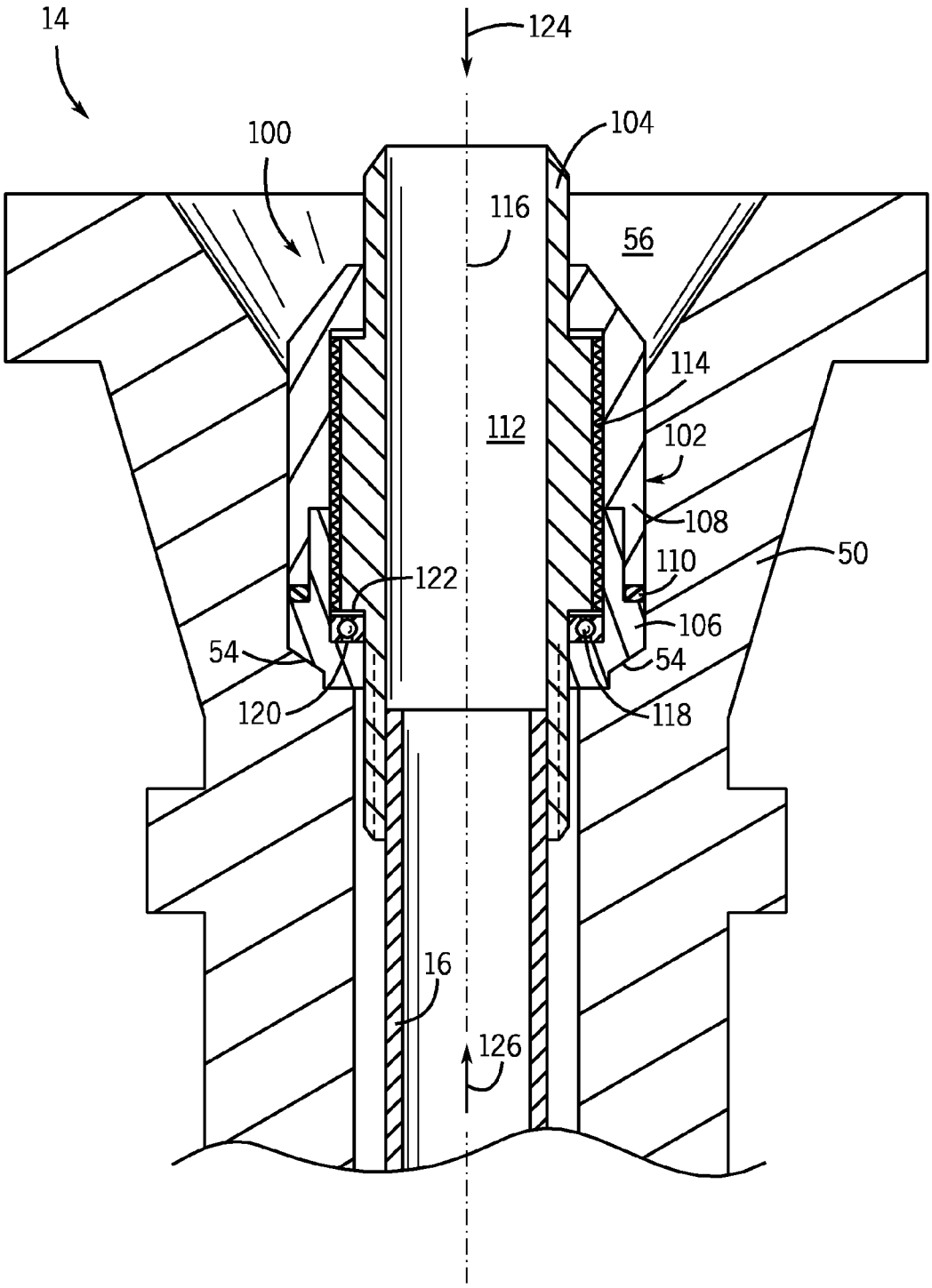
FIG. 3 is a schematic partial cross-sectional side view of an embodiment of wellhead equipment, including a casing spool supporting an embodiment of a rotating casing hanger, in accordance with aspects of the present disclosure.

FIG. 3 is a schematic partial cross-sectional side view of the wellhead equipment 14, illustrating the casing spool 50 supporting a rotating casing hanger 100 within the bore 56 of the casing spool 50. As mentioned above, the rotating casing hanger 100 is configured to enable rotation of the casing 16 after the casing 16 is landed within the wellbore 24. That is, once the casing 16 is in place within the wellbore 24 and suspended by the rotating casing hanger 100, the rotating casing hanger 100 may enable rotation of the casing 16. For example, the casing hanger 100 may be abutted against the casing spool 50 to land the casing 16, and then the casing 16 may be rotated by rotating components of the casing hanger 100 to facilitate certain operations. Indeed, the casing 16 may be rotated as cement 26 is pumped through the casing 16 and into the wellbore 24, thereby improving the efficiency and/or effectiveness (e.g., cement bond) of the cementing process (e.g., securing the casing 16 within the wellbore 24 with the cement 26).

In the illustrated embodiment, the rotating casing hanger 100 include a housing 102 and a casing hanger body 104. In certain embodiments, the housing 102 and the casing hanger body 104 may be made from steel or other metal. As shown, the housing 102 surrounds and supports the casing hanger body 104. Additionally, the housing 102 of the rotating casing hanger 100 is engaged with and supported by the casing spool 50. That is, the housing 102 abuts the load shoulder 54 of the casing spool 50 such that the casing spool 50 may support the weight of the rotating casing hanger 100 and any casing 16 held by the rotating casing hanger 100. Furthermore, the housing 102 may comprise multiple components. For example, in the illustrated embodiment, the housing 102 includes a lower portion 106 and an upper portion 108. Additionally, a seal 110 is captured between the lower portion 106 of the housing 102, the upper portion 108 of the housing 102, and the casing spool 50. More specifically, the seal 110 is captured between the lower portion 106 and the upper portion 108, and the seal 118 is configured to abut the casing spool 50 when the rotating casing hanger 100 is landed in the bore 56 of the casing spool 50. In certain embodiments, the seal 110 may be an elastomer seal, an O-ring, or other seal. As discussed below, the seal 110 is isolated from the casing hanger body 104, which may be configured for rotation within the housing 102. Consequently, rotation of the casing hanger body 104 within the housing 102 may not result in degradation of the seal 110.

As mentioned above, the casing hanger body 104 is at least partially surrounded by the housing 102 of the rotating casing hanger 100 and is configured to couple to the casing 16 that is lowered into the wellbore 24. For example, the casing hanger body 104 may couple to the casing 16 using a slip type, seal sealing, or mandrel type connection. The casing hanger body 104 also has a passage 112 through which cement 26, production fluid, drilling fluid, or other fluid may flow. Furthermore, the casing hanger body 104 may be configured to couple to other components of the wellhead equipment 14, such as a landing string.

To facilitate rotation of the casing hanger body 104 within the housing 102, a rotary bearing 114 is disposed between the casing hanger body 104 and the housing 102. For example, the rotary bearing 114 may include roller bearings or an annular sleeve that at least partially surrounds the casing hanger body 104 and supports ball bearings. The rotary bearing 114 may operate to allow rotation of the casing hanger body 104 within the housing 102 about an axis 116. In this manner, the casing 16 held and supported by the casing hanger body 104 may rotate within the wellbore 24 while the housing 102 remains stationary. Specifically, the housing 102 remains stationary relative to the casing spool 50. In certain embodiments, additional seals may be disposed between the rotary bearing 114 and the housing 102 and/or the casing hanger body 104. For example, the seals may be redundant seals that serve as back-up seals to the seal 110. As will be appreciated, rotation of the casing hanger body 104 and the casing 16 may be initiated by a top drive, tool or other mechanism.

Moreover, the rotating casing hanger 100 includes a thrust bearing 118 disposed between the housing 102 and the casing hanger body 104. Specifically, the thrust bearing 118 abuts an inner shoulder 120 of the lower housing 106 and an outer shoulder 122 of the casing hanger body 104. As a result, the thrust bearing 118 may transfer the load of the casing hanger body 104 and the casing 16 (e.g., an axial load) to the housing 102 of the rotating casing hanger 100. In certain embodiments, the thrust bearing 118 may be a ball thrust bearing having ball bearings supported by a ring that extends about the casing hanger body 104. In other embodiments, the thrust bearing 118 may be a roller thrust bearing, a fluid bearing, a magnetic bearing, or other type of thrust bearing configured to support and transfer an axial load. As mentioned above, the bearings 114 and 118 of the rotating casing hanger 100 allow the casing hanger body 104 to be isolated from the seal 110 captured by the lower and upper housing portions 106 and 108. That is, the bearings 114 and 118 enable rotation of the casing hanger body 104 within the housing 102 of the rotating casing hanger 100 while the housing 102 remains stationary or static (e.g., the housing 102 does not rotate). As a result, degradation to the seal 110 may be reduced as the casing hanger body 104 and the casing 16 are rotated after the casing hanger body 104 and the casing 16 are landed.

As discussed above, the rotary bearing 114 and/or the thrust bearing 118 may be subjected to loads from the casing hanger body 104. Consequently, in certain embodiments of the rotating casing hanger 100, the rotary bearing 114 and/or the thrust bearing 118 may be pre-loaded. More specifically, the rotary bearing 114 and/or the thrust bearing 118 may have a permanent load applied to the respective bearing in order to obtain a desired clearance when the rotary bearing 114 and/or the thrust bearing 118 is disposed between the housing 102 and the casing hanger body 104 of the rotating casing hanger 100. In this manner, the rotary bearing 114 and/or the thrust bearing 118 may be configured to accommodate various loads placed on the bearings 114 and 118 by the casing hanger body 104, the casing 16, and/or other components of the wellhead equipment 14. For example, after the rotating casing hanger 100 and the casing 16 are landed within the casing spool 50 and the wellbore 24, a downward axial force, represented by arrow 124, may be applied to the casing hanger body 104 by a top drive, tool, or other equipment component. Thereafter, cement 26 may be pumped into the wellbore 24 through the casing hanger body 104 and the casing 16. As the cement 26 fills the wellbore 24, the casing 16 may experience a buoyancy effect or force in a direction 126, which may also be absorbed by the bearings 114 and 118. Furthermore, the force applied on the casing hanger body 104 in the direction 124 (e.g., by the top drive, tool, or other wellhead equipment 14 component) may be adjusted (e.g., partially overcome) as the buoyancy force in the direction 126 increases. By providing and accommodating sufficient force in the direction 124, present embodiments enable maintaining a stationary position of the casing hanger 100 and casing 16 without further adjustment to the wellhead equipment during operations in response to forces in the direction 126, such as cementing.

FIGS. 4 and 5 are axial top views of embodiments of the rotating casing hanger 100. For example, FIG. 4 illustrates a configuration of the rotating casing hanger 100 similar to the embodiment shown in FIG. 3. As described above, the casing hanger body 104 is surrounded by the housing 102 and is configured to rotate within the housing 102. Specifically, rotation of the casing hanger body 104 within the housing 102 may be facilitated by the rotary bearing 114 and/or the thrust bearing 118. Additionally the bearings 114 and 118 may be pre-loaded and/or configured to transfer a load from the casing hanger body 104 to the housing 102 of the rotating casing hanger 100.

FIG. 5 illustrates an embodiment of the rotating casing hanger 100 having a fluted configuration. More specifically, the lower and upper housing portions 106 and 108 of the housing 102 are splined. That is, the lower and upper housing portions 106 and 108 have grooves 150 formed in respective outer surfaces 152 of the lower and upper housings portions 106 and 108. As will be appreciated, the fluted configuration of the rotating casing hanger 100 may accommodate a return cement 26 flow (e.g., through the grooves 150). As similarly discussed above, the rotating casing hanger 100 with a fluted configuration surrounds the casing hanger body 104, with bearings 114 and 118 disposed between the housing 102 and the casing hanger body 104, thereby enabling rotation of the casing hanger body 104 within the housing 102. Furthermore, embodiments of the rotating casing hanger 100 with a fluted configuration may include other components, such as a separate pack off assembly or other components. In non-fluted embodiments of the rotating casing hanger 100 (e.g., the embodiment shown in FIG. 3), the return cement 26 flow may pass through a lower casing valve or other exit flow path. For example, a lower casing valve may be located below the casing spool 50 where the casing 16 is set within the wellbore 24.

FIG. 6 is a flow chart describing a method 170 of using the rotating casing hanger 100. As indicated by reference numeral 172, the method 170 includes coupling the casing 16 to the rotating casing hanger 100. More specifically, the casing 16 is secured to the casing hanger body 104 of the rotating casing hanger 100, as discussed above. For example, the casing 16 may be coupled to the casing hanger body 104 of the rotating casing hanger 100 with a slip type connection, a mandrel type connection, or a self sealing connection.

Thereafter, the rotating casing hanger 100 is landed in the casing spool 50, thereby landing the casing 16 in the wellbore 24, as indicated by reference numeral 174. As discussed above, the rotating casing hanger 100 is disposed within the bore 56 of the casing spool 50, and the housing 102 of the rotating casing hanger 100 is supported by the load shoulder 54 of the casing spool 50. In this manner, the load (e.g., axial load) of the casing 16 and the rotating casing hanger 100 is transferred to the casing spool 50. Once the rotating casing hanger 100 is landed in the casing spool 50, a downward axial force may be applied to the rotating casing hanger 100 to at least partially balance out buoyancy forces acting on the casing 16 when cement 26 is later disposed within the wellbore 24.

As indicated by reference numeral 176, the rotating casing hanger 100 may be rotated within the casing spool 50 causing the casing 16 to rotate within the wellbore 24. More specifically, the casing hanger body 104, which supports and suspends the casing 16, may be rotated within the housing 102 of the rotating casing hanger 100. In other words, the housing 102 remains stationary relative to the casing spool 50 while the casing hanger body 104 rotates within the housing 102 of the rotating casing hanger 100. In this manner, degradation of the seal 110 between the housing 102 and the casing spool 50 may be reduced even though the rotating casing hanger 100 is rotating the casing 16 within the wellbore 24 after the rotating casing hanger 100 is landed in the casing spool 50. As discussed above, rotation of the casing hanger body 104 within the housing 102 may be facilitated by a rotary bearing 114 and/or a thrust bearing 118. In certain embodiments, the bearings 114 and 118 may be pre-loaded to accommodate forces (e.g., axial forces) applied on the rotating casing hanger 100 and the casing 16.

Once the rotating casing hanger 100 and the casing 16 are landed, cement 26 may be pumped into the wellbore 24 through the rotating casing hanger 100 and the casing 16, as represented by reference numeral 178. As will be appreciated, the cement 26 may eventually set within the wellbore 24 to secure the casing 16 within the wellbore 24. For example, the cement 26 may be pumped into the wellbore 24 while rotating the casing hanger 100 facilitates rotation of the casing 16 within the wellbore 24. In this manner, the efficiency and/or effectiveness of the cementing of the casing 16 within the wellbore 26. In certain embodiments, settling of the cement 26 within the wellbore 24 (e.g., between the wellbore 24 and the casing 16) may be improved.

As discussed in detail above, the disclosed embodiments are directed to the rotating casing hanger 100, which may be used with down-hole equipment, such as the well 10. For example, the rotating casing hanger 100 may be used for rotating casing 16 while drilling the well 10 or while cementing the casing 16 within the wellbore 24 of the well 10. More specifically, in certain embodiments, the casing 16 supported by the rotating casing hanger 100 may be landed before the space or gap between the wellbore 24 and the casing 16 is filled with cement 26 to secure the casing 16 within the wellbore 24. Thereafter, cement 26 may be pumped into the wellbore 24, while the casing 16 is rotated by the rotating casing hanger 100. In other words, the casing 16 may be positioned within the wellbore 24 and supported by the rotating casing hanger 100, which is supported by the casing spool 50. Once the rotating casing hanger 100 is supporting the casing 16 within the wellbore 24, cement 26 may be pumped through the passage 112 of the casing 16 to the bottom of the wellbore 24. The cement 26 may fill the space or gap between the wellbore 24 and the casing 16, thereby fixing the casing 16 in place within the wellbore 24. As the cement 26 is pumped into the wellbore 24, the rotating casing hanger 100 may enable rotation of the casing 16 within the wellbore 24. In this manner, the cementing process may be improved. In certain embodiments, the rotating of the casing 16 while the casing 16 is cemented in place may improve efficiency of the cementing process and/or may improve the quality of the cementing process. For example, the settling of the cement 26 between the wellbore 24 and the casing 16 may be improved. Furthermore, embodiments of the rotating casing hanger 100 disclosed below may be configured to maintain a seal (e.g., with the seal 110) between the rotating casing hanger 100 and the casing spool 50 while rotating the casing 16 within the wellbore 24.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a rotating casing hanger, comprising:

a housing configured to abut a casing spool, wherein an outer circumferential surface of the housing has grooves configured to facilitate fluid flow therethrough; and a casing hanger body disposed within the housing, wherein the casing hanger body is configured to suspend a casing element to be cemented within a wellbore, and the casing hanger body is configured to rotate within the housing.

2. The system of claim 1, wherein the housing comprises an upper housing portion and a lower housing portion, wherein the lower housing portion is configured to abut a load shoulder of the casing spool.

3. The system of claim 2, wherein a seal is at least partially captured by the upper housing portion and the lower housing portion, and the seal is configured to abut the casing spool when the rotating casing hanger is disposed within the casing spool.

4. The system of claim 1, wherein the rotating casing hanger comprises a bearing disposed between the housing and the casing hanger body, and the bearing is configured to facilitate rotation of the casing hanger body within the housing.

5. The system of claim 4, wherein the bearing comprises a thrust bearing, and the thrust bearing is configured to transfer an axial load from the casing hanger body to the housing.

6. The system of claim 4, wherein the bearing comprises a rotary bearing disposed at least partially about the casing hanger body.

7. The system of claim 4, wherein the rotary bearing is pre-loaded.

8. A casing hanger, comprising:

a housing, comprising:

a first housing portion comprising a first plurality of grooves formed in a first outer circumferential surface of the first housing portion;

a second housing portion comprising a second plurality of grooves formed in a second outer circumferential surface of the second housing portion; and a seal at least partially captured by the first housing portion and the second housing portion, wherein the seal is configured to abut a casing spool when the casing hanger is disposed within the casing spool; and a casing hanger body disposed within the housing, wherein the casing hanger body is configured to couple to a casing element to be cemented within a wellbore and rotate within the housing.

9. The casing hanger of claim 8, comprising at least one bearing disposed between the housing and the casing hanger body, wherein the at least one bearing is configured to facilitate rotation of the casing hanger body within the housing.

10. The casing hanger of claim 9, wherein the at least one bearing is configured to transfer a load from the casing hanger body to the housing.

11. The casing hanger of claim 9, wherein the at least one bearing is pre-loaded.

12. The casing hanger of claim 8, wherein each of the first and second pluralities of grooves extends along a central axis of the housing.

13. The casing hanger of claim 8, wherein the housing and the casing hanger body are configured to flow a fluid while the casing hanger body rotates within the housing.

14. A method, comprising:

coupling a casing element to be cemented within a wellbore to a casing hanger;

landing the casing hanger in a casing spool and the casing element in the wellbore;

rotating the casing hanger within the casing spool and the casing element within the wellbore while the casing hanger is landed in the casing spool and the casing element is landed in the wellbore;

disposing cement in the wellbore through the casing hanger and the casing element, while rotating the casing hanger and the casing element, to facilitate securing the casing element within the wellbore, and flowing a return cement flow between the casing hanger and the casing spool through a plurality of grooves formed in an outer circumferential surface of the casing hanger.

15. The method of claim 14, wherein rotating the casing hanger within the casing spool and the casing element within the wellbore comprises rotating a casing hanger body of the casing hanger within a housing of the casing hanger, wherein the casing element is coupled to the casing hanger body.

16. The method of claim 14, comprising applying a downward force on the casing hanger while rotating the casing hanger within the casing spool and disposing cement in the wellbore.

17. The method of claim 14, wherein the casing hanger comprises a seal configured to abut the casing spool when the casing hanger is landed in the casing spool.

18. The method of claim 14, wherein rotation of the casing hanger within the casing spool is facilitated by a thrust bearing disposed between a casing hanger body of the casing hanger and a housing of the casing hanger.

* * * * *